US009682552B2

(12) United States Patent
Kato et al.

(10) Patent No.: US 9,682,552 B2
(45) Date of Patent: Jun. 20, 2017

(54) LIQUID EJECTION HEAD, METHOD OF CLEANING THE SAME, AND RECORDING APPARATUS

(71) Applicant: CANON KABUSHIKI KAISHA, Tokyo (JP)

(72) Inventors: Maki Kato, Fuchu (JP); Ichiro Saito, Yokohama (JP); Yoshinori Misumi, Tokyo (JP); Takahiro Matsui, Yokohama (JP); Yuzuru Ishida, Yokohama (JP); Norihiro Yoshinari, Kawasaki (JP); Akio Goto, Tokyo (JP); Atsushi Koike, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/134,665

(22) Filed: Apr. 21, 2016

(65) Prior Publication Data

US 2016/0325548 A1 Nov. 10, 2016

(30) Foreign Application Priority Data

May 8, 2015 (JP) ..... 2015-095647

(51) Int. Cl.
*B41J 2/14* (2006.01)

(52) U.S. Cl.
CPC ..... *B41J 2/14129* (2013.01); *B41J 2/14072* (2013.01); *B41J 2/14016* (2013.01); *B41J 2/14056* (2013.01)

(58) Field of Classification Search
CPC B41J 2/14129; B41J 2/14072; B41J 2/14016; B41J 2/14056
See application file for complete search history.

(56) References Cited

U.S. PATENT DOCUMENTS

| | | | | |
|---|---|---|---|---|
| 6,439,680 | B1 | 8/2002 | Mochizuki et al. | |
| 7,055,923 | B2 | 6/2006 | Mochizuki et al. | |
| 7,108,345 | B2 | 9/2006 | Mochizuki et al. | |
| 7,306,327 | B2 | 12/2007 | Sakai et al. | |
| 7,641,316 | B2 | 1/2010 | Sakai et al. | |
| 7,950,769 | B2 | 5/2011 | Sakai et al. | |
| 8,123,330 | B2 | 2/2012 | Sakai et al. | |
| 8,491,087 | B2 | 7/2013 | Sakai et al. | |
| 8,646,169 | B2 | 2/2014 | Ishida et al. | |
| 9,308,722 | B2 | 4/2016 | Ishida et al. | |
| 2014/0318976 | A1* | 10/2014 | Takahashi | C25D 7/00 205/127 |

FOREIGN PATENT DOCUMENTS

JP 2008-105364 A 5/2008

* cited by examiner

*Primary Examiner* — Manish S Shah
*Assistant Examiner* — Yaovi M Ameh
(74) *Attorney, Agent, or Firm* — Fitzpatrick, Cella, Harper & Scinto

(57) ABSTRACT

When cleaning is performed to remove kogation, which is deposited on a heat acting portion, by causing an electrochemical reaction through application of a voltage between an upper electrode and an opposing electrode, a wiring located at a periphery of the opposing electrode occludes hydrogen generated during the cleaning, thereby causing hydrogen embrittlement. A unit configured to heat the wiring connected to the opposing electrode is provided, and is driven during the cleaning or after the cleaning, to thereby force hydrogen out of the wiring. Thus, the hydrogen embrittlement of the wiring is suppressed.

12 Claims, 8 Drawing Sheets

LIQUID EJECTION HEAD, METHOD OF CLEANING THE SAME, AND RECORDING APPARATUS

BACKGROUND OF THE INVENTION

Field of the Invention

The present invention relates to a liquid ejection head configured to eject ink with a liquid ejection system to perform recording on a recording medium, and to a method of cleaning the liquid ejection head. Further, the present invention relates to a recording apparatus including the liquid ejection-head.

Description of the Related Art

A liquid ejection system (ink jet recording system) is configured to eject liquid (for example, ink) through ejection orifices provided in a liquid ejection head, and to cause the liquid to adhere onto a recording material such as paper, to thereby perform recording. The ink jet recording system, which is configured to eject liquid through use of bubbles formed in the liquid due to thermal energy generated by electrothermal conversion elements, is capable of achieving high image quality and high-speed recording.

This type of liquid ejection head generally includes a plurality of ejection orifices, flow paths communicating with the ejection orifices, and a plurality of electrothermal conversion elements configured to generate thermal energy to be used for ejecting ink. Each of the electrothermal conversion elements is formed of a heating element and an electrode configured to supply electric power to the heating element. The electrothermal conversion element is covered with a lower protective layer having an insulating property, which is formed of, for example, a silicon nitride, so that the insulating property is secured between the ink and the electrothermal conversion element.

During liquid ejection, a heat generation portion of the electrothermal conversion element is exposed to high temperature and subjected to a cavitation impact, which is caused along with formation and shrinkage of bubbles in the liquid, in conjunction with a chemical action, which is caused by the ink. Therefore, an upper protective layer is provided on the heat generation portion so as to protect the heating element from the impact caused by the cavitation and the chemical action caused by the ink. The temperature of the surface of the upper protective layer rises up to the vicinity of 700° C., and the surface is brought into contact with the ink. For those reasons, the upper protective layer is required to have film characteristics excellent in heat resistance, mechanical characteristics, chemical stability, and alkali resistance.

Further, coloring materials or additives contained in the ink are heated at high temperature and decomposed on the molecular level, thereby causing a phenomenon that those materials are transformed into insoluble substances called "kogation". Physisorption of the kogation onto the upper protective layer causes non-uniform thermal conduction from the heating element to the ink, resulting in problems such as decrease in speed of ejected ink, instability of bubbles, and increase in energy required for ejection.

To address the problems, in Japanese Patent Application Laid-Open No. 2008-105364, there is disclosed a technology of removing the kogation by forming the surface of the upper protective layer with a material that is dissolvable through an electrochemical reaction, such as iridium or ruthenium.

SUMMARY OF THE INVENTION

In order to solve the above-mentioned problems, according to one aspect of the present invention, there is provided a liquid ejection head, including:

- a liquid ejection orifice;
- a liquid chamber communicating with the liquid ejection orifice;
- a first electrothermal conversion portion disposed to the liquid chamber;
- a protective layer having an insulating property and being configured to prevent contact between the first electrothermal conversion portion and liquid inside the liquid chamber;
- an upper electrode covering at least a heat generation portion of the protective layer, which is heated by the first electrothermal conversion portion, and being formed of a material containing a metal to be dissolved through an electrochemical reaction with the liquid;
- an opposing electrode provided such that a voltage is applied between the upper electrode and the opposing electrode for dissolution of the upper electrode;
- an opposing electrode wiring connected to the opposing electrode, the opposing electrode wiring being located at a periphery of the opposing electrode so as to be in contact with the liquid; and
- a unit configured to heat the opposing electrode wiring.

Further features of the present invention will become apparent from the following description of exemplary embodiments with reference to the attached drawings.

DESCRIPTION OF THE EMBODIMENTS

Figure 1:
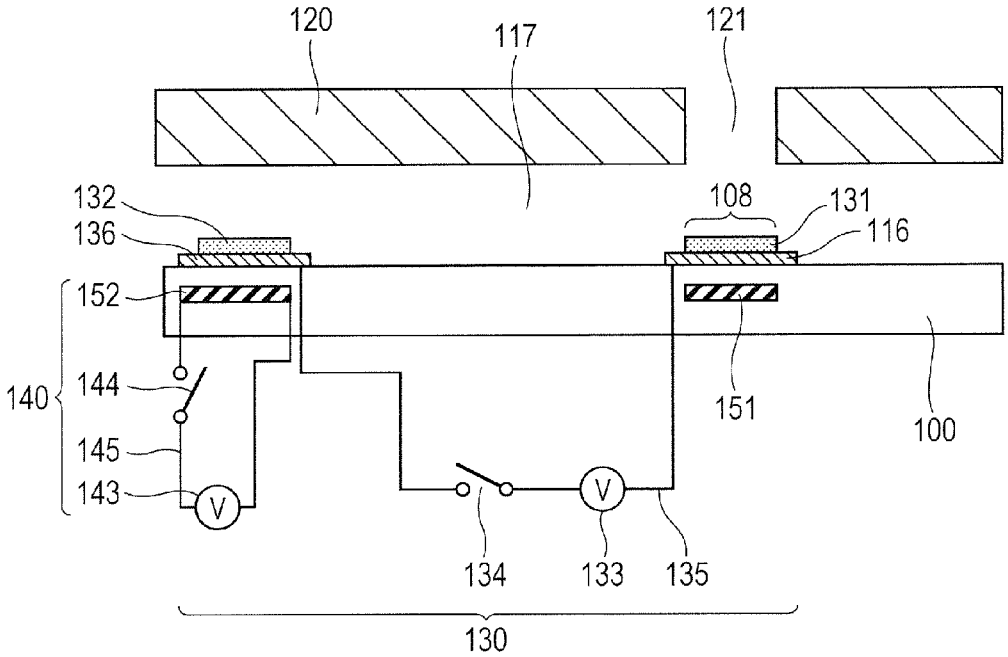
FIG. 1 is a conceptual view for illustrating a feature of a liquid ejection head according to an embodiment of the present invention.

Preferred embodiments of the present invention will now be described in detail in accordance with the accompanying drawings.

The cleaning method for removing the kogation as disclosed in Japanese Patent Application Laid-Open No. 2008-105364 utilizes the electrochemical reaction. Specifically, an upper protective layer formed of a dissolvable material serves as an anode electrode, whereas an opposing electrode disposed at a position of being conductible via liquid serves as a cathode electrode. A voltage is applied between the two electrodes to dissolve the material into the liquid, and to remove the kogation at the same time.

At this time, on the opposing electrode, hydrogen ions in the liquid are reduced into hydrogen atoms, and two hydrogen atoms are recombined with each other to generate a hydrogen gas. In this case, there arises no problem when the hydrogen atoms are smoothly recombined with each other and discharged out of the system. However, the discharge process becomes a bottleneck when the hydrogen generation rate or the hydrogen generation period is increased. In this case, the hydrogen atoms are absorbed into the materials forming the opposing electrode and a wiring electrically connected to the opposing electrode. As a result, the hydrogen atoms are recombined with each other in those materials so that material degradation called hydrogen embrittlement is liable to occur. Irrespective of whether or not the discharge process becomes a bottleneck, the problem of hydrogen embrittlement may occur also when the number of times of cleaning is increased. Several times of repetition of the kogation removal may cause disconnection due to a crack generated in the degraded portion of the material, thereby hindering the cleaning operation. As a result, the head reaches the end of its life even though the anode electrode still remains. Thus, the head reaches the end of its life earlier than the expected life of the head.

Particularly in the field of commercial printing, the cleaning tends to be performed frequently so as to enhance the print quality. Therefore, the cleaning may be performed at high voltage so as to minimize the stop period of the apparatus due to the cleaning. Along with this operation, the hydrogen generation rate or the hydrogen generation period is increased so that the hydrogen generation amount is increased. As a result, disconnection of the opposing electrode wiring is liable to become conspicuous, thereby arousing a demand for measures against the disconnection.

As a measure against the above-mentioned hydrogen embrittlement, heat treatment is generally performed at several hundreds of degrees Celsius for several hours. When the heat treatment is performed for the ink jet head, however, the ink may degrade or firmly adhere to the inside of the liquid chamber, thereby causing a risk in that the proper printing operation is hindered.

The present invention has been accomplished in view of the above-mentioned circumstances, and it is therefore an object thereof to provide a liquid ejection head and a method of cleaning the liquid ejection head, which are capable of suppressing the hydrogen embrittlement of the wiring material without affecting the print quality.

According to the present invention, the hydrogen embrittlement that is a factor in the disconnection can be suppressed by heating the wiring material, which may be affected by generation of hydrogen, during the cleaning operation on the periphery of the opposing electrode.

As a result, the cleaning operation can securely be performed until the expected life of the head to stabilize ejection characteristics of the liquid ejection head, thereby being capable of performing reliable and high-quality image recording.

The feature of the present invention is to suppress degradation of the opposing electrode wiring due to hydrogen, which may be generated during the cleaning, by heating a part of the opposing electrode wiring that is located inside the liquid chamber on the periphery of the opposing electrode. The part of the opposing electrode wiring that is located inside the liquid chamber is a part to be brought into contact with the liquid inside the liquid chamber on the periphery of the opposing electrode. Further, the periphery of the opposing electrode refers to a region to be exposed to hydrogen generated on the opposing electrode.

Now, the present invention is described in detail with reference to the attached drawings.

(1. Liquid Ejection Head of Present Invention)

FIG. 1 is a schematic view for illustrating a cleaning unit 130 and a heating unit 140 of a liquid ejection head according to an embodiment of the present invention.

The liquid ejection head according to the embodiment of the present invention includes a liquid ejection head board 100 on which semiconductor devices (not shown) are formed, liquid ejection orifices 121, and a flow path forming member 120 defining a liquid chamber 117 communicating with each of the liquid ejection orifices 121. Heat acting portions 108 corresponding to the respective liquid ejection orifices 121 are provided on the liquid ejection head board 100 to apply heat as ejection energy to liquid (ink) inside the liquid chamber 117. Each of the heat acting portions 108 is a portion to be heated by a first electrothermal conversion portion 151, which is formed on the liquid ejection head board 100, and is protected by a protective layer (not shown) having an insulating property and being configured to prevent contact between the first electrothermal conversion portion 151 and the liquid inside the liquid chamber 117. A close-contact wiring layer 116 and an upper electrode 131 located thereon are provided above the first electrothermal conversion portion 151. In order to remove kogation to be formed on the surface of the upper electrode 131 serving as the heat acting portion 108 as a result of performing a predetermined number of times of liquid ejection, the cleaning unit 130 according to this embodiment includes an opposing electrode 132 as an electrode paired with the upper electrode 131. The upper electrode 131 functions as a protective layer configured to protect the first electrothermal conversion portion 151 from chemical and physical impacts to be caused along with formation of bubbles in the ink, and also functions to remove the kogation during cleaning processing.

The upper electrode 131 and the opposing electrode 132 are electrically connected to each other through a wiring path 135 routed via a power source 133 and a switch 134 so that an electrically closed circuit may be provided via the liquid inside the liquid chamber 117. The components forming the closed circuit are collectively referred to as "cleaning unit 130". During a recording (printing) operation, thermal energy is applied a predetermined number of times at the heat acting portion 108. During this period, the switch 134 of the closed circuit is opened or the power supply from the power source 133 of the closed circuit is stopped. A cleaning operation (kogation removal) is performed after kogation is accumulated to some extent on the surface of the upper electrode 131 serving as the heat acting portion 108. The kogation removal involves causing an electrochemical reaction at an interface between the upper electrode 131 and the ink by closing the circuit. Through the electrochemical reaction, the surface of the upper electrode 131 is dissolved into the ink, to thereby remove the kogation adhering onto the surface of the upper electrode 131. The upper electrode 131, the opposing electrode 132, and a wiring layer forming a part of the wiring path 135 are disposed inside the liquid ejection head, whereas the switch 134 and the power source 133 are disposed outside the liquid ejection head. The switch 134 may be disposed inside the liquid ejection head. The cleaning unit disposed inside the liquid ejection head may be referred to as "internal cleaning unit", whereas the cleaning unit disposed outside the liquid ejection head may be referred to as "external cleaning unit".

In this embodiment, a second electrothermal conversion portion 152 is provided in the liquid ejection head board 100 at a position below the opposing electrode 132 and a close-contact wiring layer 136 is located immediately below the opposing electrode 132.

The second electrothermal conversion portion 152 is electrically connected through a wiring path 145 routed via a switch 144 and a power source 143 configured to apply a voltage. The second electrothermal conversion portion 152 and the components forming a circuit configured to drive the second electrothermal conversion portion 152 are collectively referred to as "unit configured to heat an opposing electrode wiring (heating unit 140)". A part of the wiring path 145 is disposed inside the liquid ejection head, whereas the power source 143 and the switch 144 are disposed as an external circuit. The switch 144 may be disposed inside the liquid ejection head. The circuit configured to drive the second electrothermal conversion portion 152 may have the same circuit structure as a circuit configured to drive the first electrothermal conversion portion 151, or a part of the circuit configured to drive the first electrothermal conversion portion 151 may also serve as a part of the circuit configured to drive the second electrothermal conversion portion 152. The circuit configured to drive the first electrothermal conversion portion 151 has circuit structure that is publicly known hitherto, including the semiconductor devices (not shown) provided on the liquid ejection head board 100, and a power supply circuit provided inside a recording apparatus described later. Thus, a part of the circuit configured to drive the second electrothermal conversion portion 152 may be provided inside the liquid ejection head, whereas the rest of the circuit may be provided outside the liquid ejection head.

Figure 2:
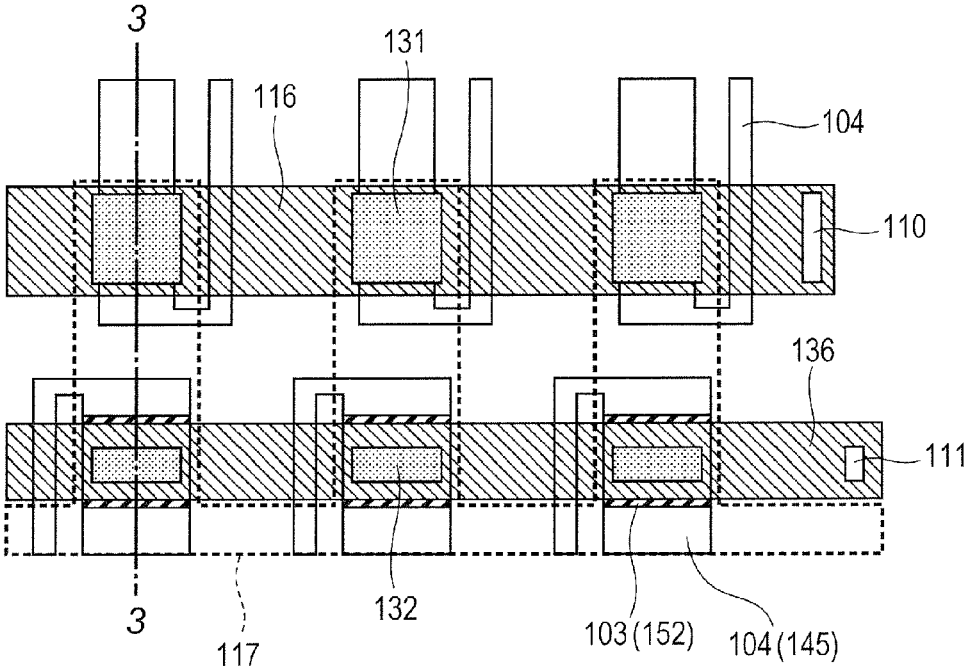
FIG. 2 is a top view for illustrating an example of a wiring layout of the liquid ejection head according to the embodiment of the present invention.
Figure 3:
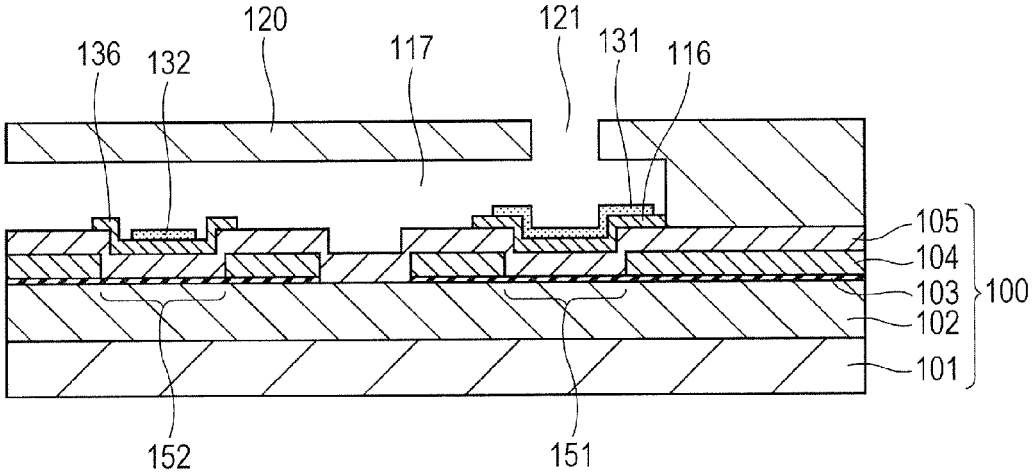
FIG. 3 is a sectional view taken along the line 3-3 of FIG. 2.

FIG. 2 is a top view for illustrating an example of a wiring layout of the liquid ejection head according to the embodiment of the present invention. FIG. 3 is a sectional view taken along the line 3-3 of FIG. 2. As illustrated in FIG. 3, the liquid ejection head board 100 includes a heat generating resistor layer 103 provided on a substrate 101 formed of silicon or other materials through intermediation of a heat accumulation layer 102 formed of an insulating material such as $SiO_2$ or SiN. The heat generating resistor layer 103 is formed of a publicly-known material such as TaSiN. A wiring layer 104 formed of a metal material such as Al, Al—Si, or Al—Cu to serve as wirings is provided on the heat generating resistor layer 103. A part of the wiring layer 104 is removed to form a gap, in which a part of the heat generating resistor layer 103 is exposed to serve as each of the first electrothermal conversion portion 151 and the second electrothermal conversion portion 152. A protective layer 105 having an insulating property, which is formed of an insulating material such as $SiO_2$ or SiN, and is configured to prevent contact between each of the first electrothermal conversion portion 151 and the second electrothermal conversion portion 152 and the liquid inside the liquid chamber 117, is provided on the wiring layer 104. The close-contact wiring layer 116 is provided on the protective layer 105. The periphery of the first electrothermal conversion portion 151 including the protective layer 105 may be referred to as "heat generation portion". A part of the close-contact wiring layer 116 is connected to a part of the wiring layer 104, which is electrically isolated from each of the first electrothermal conversion portion 151 and the second electrothermal conversion portion 152, via a through hole 110 provided in the protective layer 105 (not shown). On the other hand, the opposing electrode 132 is provided on the protective layer 105 through intermediation of the close-contact wiring layer 136. The close-contact wiring layer 136 is connected to a part of the wiring layer 104, which is electrically isolated from each of the first electrothermal conversion portion 151 and the second electrothermal conversion portion 152, via a through hole 111 formed in the protective layer 105 (not shown). The wiring layer 104 electrically connected to each of the upper electrode 131 and the opposing electrode 132 serves as a part of the wiring path 135 illustrated in FIG. 1. The wiring layer 104 is connected to an external circuit, which is provided inside the recording apparatus described later, via a terminal portion (not shown) provided at an end portion of the liquid ejection head board 100. In this embodiment, a plurality of electrically-isolated wirings are provided. For example, among the wirings formed by laminating the heat generating resistor layer 103 and the wiring layer 104 that are provided below the protective layer 105, one of the wirings serves as the first electrothermal conversion portion 151 provided in the gap of the wiring layer 104. The other one of the wirings serves as the second electrothermal conversion portion 152 provided in the gap of the wiring layer 104, and also as a part of the wiring path 145 and a part of the wiring path 135.

Each of the close-contact wiring layers 116 and 136 is a layer configured to enhance close contact between the protective layer 105 and a corresponding one of the upper electrode 131 and the opposing electrode 132, and also serves as a part of the wiring path 135 through use of a conductive material. It is preferred that each of the close-contact wiring layers 116 and 136 be formed of a material having excellent thermal conductivity capable of transferring heat generated by the first electrothermal conversion portion 151 to the heat acting portion 108 in contact with the liquid without heat loss. Any material may be used for each of the close-contact wiring layers 116 and 136 as long as those properties are satisfied. When each of the close-contact wiring layers 116 and 136 is partially brought into contact with the liquid inside the liquid chamber 117, a material having liquid resistance is preferred. The close-contact wiring layer 116 is formed of a material that is less liable to dissolve than that for the upper electrode 131 at a voltage for dissolving the upper electrode 131 through the electrochemical reaction during the cleaning. A valve metal such as tantalum (Ta) or niobium (Nb) having a property that a passivation film is provided on the surface of the close-contact wiring layer 116 may be used preferably. The same valve metal may be used preferably for the close-contact wiring layer 136. When the same material is used, the close-contact wiring layers 116 and 136 can be formed at the same time. In the present invention, the close-contact wiring layer 136 serves as the opposing electrode wiring. Further, the close-contact wiring layer 116 may be referred to as "upper electrode wiring". Particularly when the close-contact wiring layer 136 serving as the opposing electrode wiring is formed of a material containing Ta or Nb, an oxide film being a passivation film is reduced by hydrogen to degrade the wiring protection function, thereby becoming susceptible to hydrogen embrittlement. Therefore, heat treatment to be performed by the heating unit 140 for the opposing electrode wiring according to the present invention is more effective for the opposing electrode wiring using those materials.

The upper electrode 131 originally functions to remove the kogation by being dissolved into the liquid through the electrochemical reaction, and also functions as an upper protective layer configured to protect the first electrothermal conversion portion 151 from physical and chemical impacts. Further, the upper electrode 131 is required to have excellent thermal conductivity as the heat acting portion 108 configured to transfer the heat generated by the first electrothermal conversion portion 151 to the liquid. Whether or not the metal is dissolved through the electrochemical reaction may generally be grasped based on potential-pH diagrams of various metals. As the material for the upper electrode 131, there may preferably be used a material having a preferred ejection range and being prevented from forming a rigid oxide film by heating at about 700° C. As this material, it is preferred to select Ir alone, Ru alone, an alloy of Ir and another metal, or an alloy of Ru and another metal. Particularly in the kogation removal function, the electrochemical reaction proceeds more efficiently as the content of Ir or Ru becomes larger, and hence Ir alone or Ru alone is most preferred. However, the effects of the present invention may be attained also when the Ir alloy or the Ru alloy is selected. As described above, the effects of the present invention are attained as long as the material contains at least Ir or Ru.

The opposing electrode 132 is also brought into contact with the liquid inside the liquid chamber 117 as in the case of the upper electrode 131, and hence any material may be used as long as the material is electrically stable even in contact with the liquid. For example, the same metal material as that for the upper electrode 131 may be used. When the same metal material as that for the upper electrode 131 is used, the upper electrode 131 and the opposing electrode 132 can be formed at the same time.

Figure 4:
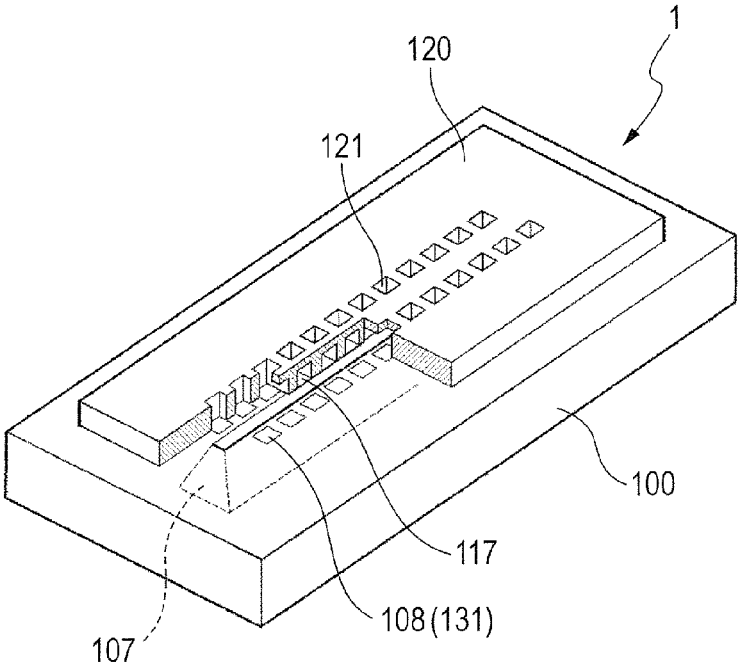
FIG. 4 is a schematic perspective view for illustrating the liquid ejection head as an example of the embodiment of the present invention.

FIG. 4 is a partially cutaway perspective view for illustrating a liquid ejection head 1 as an example of the embodiment of the present invention. The liquid ejection head 1 includes the liquid ejection head board 100 on which element arrays having the heat acting portions 108 (upper electrodes 131) provided at predetermined pitches are disposed in two parallel rows across a liquid supply path 107 passing through the liquid ejection head board 100. The liquid ejection head 1 may employ the wiring layout as illustrated in FIG. 2. The liquid ejection head of the present invention is not limited to the example illustrated in FIG. 4, but may be a head compatible with multi-color recording, such as a head in which ejection orifice arrays corresponding to respective colors are disposed in parallel to each other, or a head in which ejection orifice arrays corresponding to respective colors are disposed in series.

(2. Cleaning Operation (Kogation Removal Operation))

The kogation removal operation of the present invention utilizes an electrochemical reaction between the liquid (ink) being an electrolyte and each of the upper electrode 131 serving as an anode electrode and the opposing electrode 132 serving as a cathode electrode. The upper electrode 131 serving as the anode electrode is dissolved so that the deposited kogation can be removed along with the dissolution of the upper electrode 131. Note that, when the polarities of the upper electrode 131 and the opposing electrode 132 are reversed during the kogation removal operation as disclosed in Japanese Patent Application Laid-Open No. 2008-105364, components in the liquid, which are adsorbed or attracted to the electrode surfaces during the kogation removal operation, can be released into the liquid again. When the polarities are reversed, hydrogen is generated on the upper electrode 131, and the upper electrode wiring (close-contact wiring layer 116) located on the periphery of the upper electrode 131 is exposed to hydrogen. However, the upper electrode wiring is heated at the time of liquid ejection performed by driving the first electrothermal conversion portion 151, and hence the effect of the hydrogen embrittlement on the upper electrode wiring is substantially eliminated. As a matter of course, the first electrothermal conversion portion 151 may be driven during the cleaning operation to actively force hydrogen out of the upper electrode wiring.

(3. Recording Apparatus)

Figure 5:
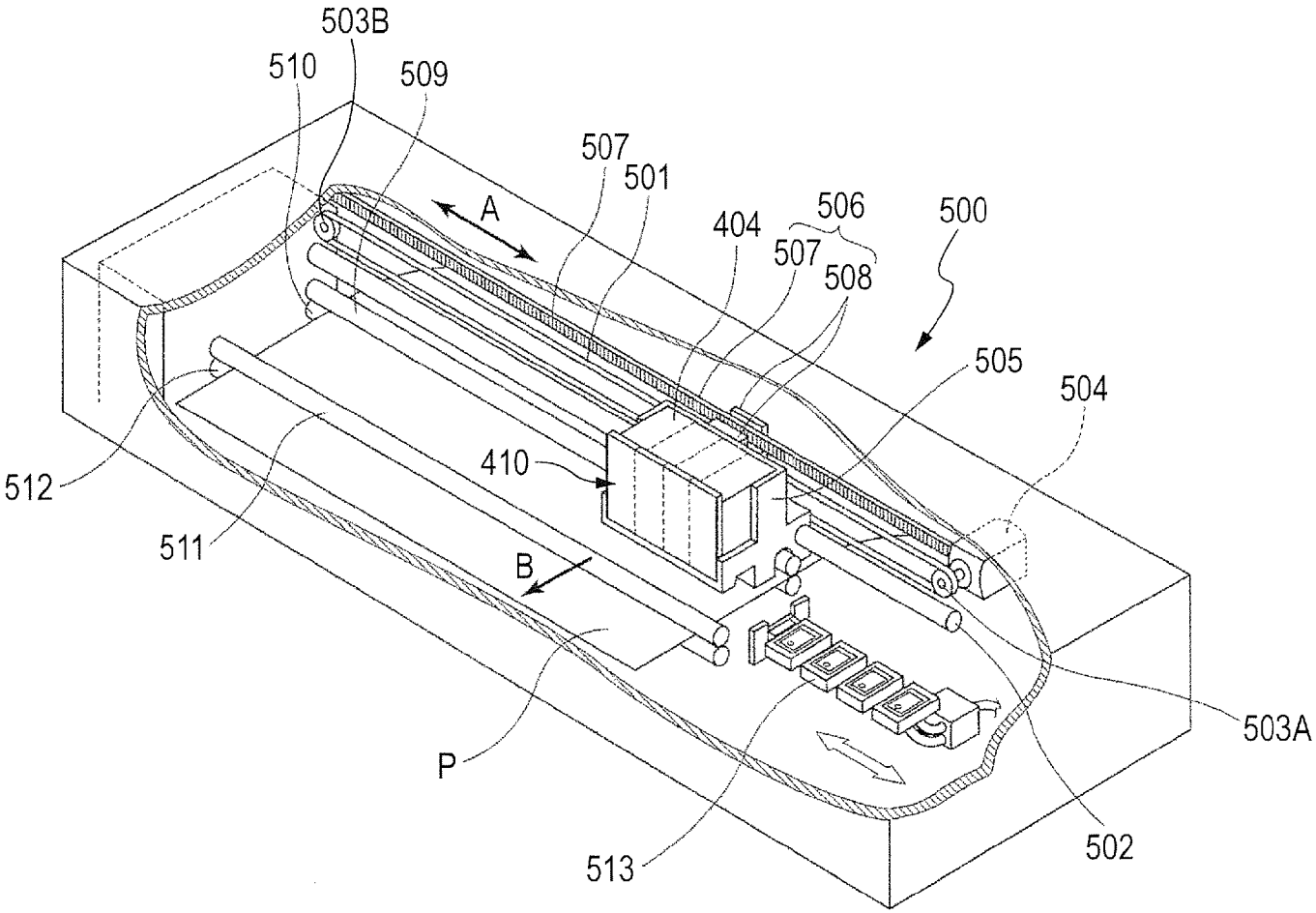
FIG. 5 is a perspective view for illustrating an example of a configuration of a recording apparatus including the liquid ejection head according to the embodiment of the present invention as a component of the recording apparatus.

FIG. 5 is a view for illustrating an example of a schematic configuration of a recording apparatus 500 according to this embodiment.

In the recording apparatus 500 illustrated in FIG. 5, a carriage 505 is fixed to an endless belt 501, and is movable along a guide shaft 502. The endless belt 501 is looped around pulleys 503A and 503B, and a drive shaft of a carriage drive motor 504 is coupled to the pulley 503A on one side. Thus, along with rotational drive of the carriage drive motor 504, main scanning of the carriage 505 is performed in a reciprocating direction (direction A) along the guide shaft 502.

Figure 6:
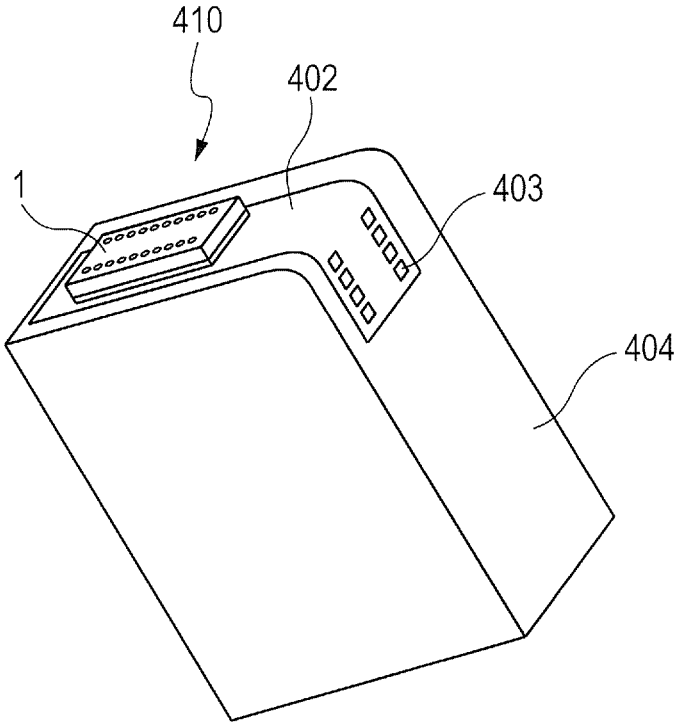
FIG. 6 is a perspective view for illustrating an example of a configuration of a head unit including the liquid ejection head according to the embodiment of the present invention as a component of the head unit.

A head unit 410 in the form of a cartridge is mounted on the carriage 505. In this case, the head unit 410 is mounted on the carriage 505 so that the liquid ejection orifices 121 of the liquid ejection head 1 are opposed to a recording sheet P serving as a recording medium, and that the array direction of the liquid ejection orifices 121 coincides with a direction (for example, a sub-scanning direction (direction B) being a conveyance direction of the recording sheet P) that is different from the main scanning direction (direction A). For example, the head unit 410 may have a configuration illustrated in FIG. 6. In FIG. 6, a tape member 402 for tape automated bonding (TAB) has a terminal for power supply to the liquid ejection head 1. The tape member 402 is capable of exchanging electric power or various signals with a recording apparatus body via contacts 403. A tank 404 is configured to supply the liquid (ink) to the liquid ejection head 1. That is, the head unit 410 of FIG. 6 is provided in the form of a cartridge mountable on the recording apparatus 500 of FIG. 5. Alternatively, the head unit 410 may be a tank-separated head unit constructed such that the liquid ejection head 1 and the tank 404 are provided separately. Further, the liquid ejection head 1 may be compatible with multi-color recording. The tank 404 may be disposed at a portion other than the carriage 505 so that the liquid is supplied through a tube or other devices to the liquid ejection head 1 mounted on the carriage 505. There may be provided as many sets of the liquid ejection head 1 and the tank 404 as the number of colors of ink to be used. In the example illustrated in FIG. 5, four sets are provided so as to correspond to four colors (for example, black, yellow, magenta, and cyan).

In addition, the recording apparatus 500 of FIG. 5 includes a linear encoder 506 for the purpose of, for example, detecting a movement position of the carriage 505 in the main scanning direction. As one component of the linear encoder 506, a linear scale 507 is provided along the movement direction of the carriage 505, and slits are provided in the linear scale 507 at regular intervals and at a predetermined density. As other components of the linear encoder 506, for example, a slit detection system 508 including a light emitting portion and a light receiving sensor, and a signal processing circuit are provided to the carriage 505. Thus, along with the movement of the carriage 505, the linear encoder 506 outputs an ejection timing signal and carriage position information for defining ink ejection timings.

The recording sheet P serving as the recording medium is intermittently conveyed in the direction of the arrow B, which is orthogonal to the scanning direction of the carriage 505. The recording sheet P is supported by a pair of roller units 509 and 510 disposed on an upstream side in the conveyance direction and a pair of roller units 511 and 512 disposed on a downstream side in the conveyance direction, and is conveyed under a state in which a predetermined tensile force is applied to secure flatness in a region opposed to the liquid ejection head 1. In this case, drive forces for the roller units 509, 510 and the roller units 511, 512 are transmitted from a conveyance motor (not shown).

With the above-mentioned configuration, recording is performed on the entire recording sheet P while the recording in a region corresponding to an array width of the liquid ejection orifices 121 of the liquid ejection head 1 and the conveyance of the recording sheet P are being alternately repeated along with the movement of the carriage 505.

Note that, the carriage 505 is stopped at a home position at the start of recording or during the recording as necessary. At the home position, cap members 513 are provided so as to cap the surfaces of the respective liquid ejection heads 1 on which the liquid ejection orifices 121 are provided (ejection orifice surfaces). A mechanism (not shown) configured to forcibly discharge the liquid inside the liquid chamber 117 by sucking the ink from the liquid ejection orifices 121 under a negative pressure generated in each cap is connected to each of the cap members 513. The mechanism thus configured to discharge the liquid by suction is generally referred to as "suction recovery mechanism", and the liquid discharge operation performed by the suction recovery mechanism is generally referred to as "suction recovery operation". Through the suction recovery operation, clogging of the liquid ejection orifices 121 or other trouble is prevented.

Figure 7:
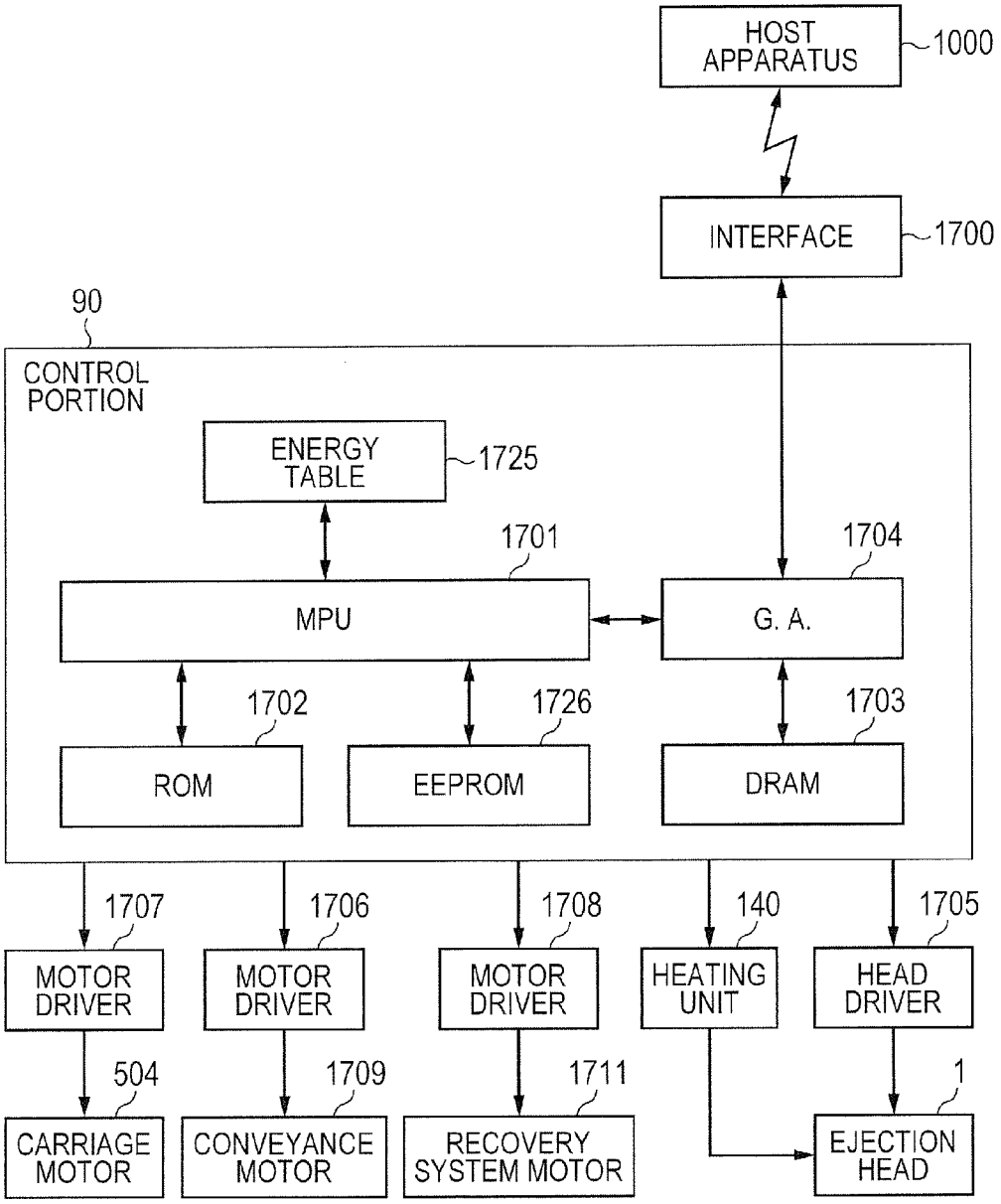
FIG. 7 is a block diagram for illustrating an example of a configuration of a control system of the recording apparatus illustrated in FIG. 5.

FIG. 7 is a block diagram for illustrating an example of a configuration of a control system of the recording apparatus 500 having the above-mentioned configuration.

In FIG. 7, an interface 1700 is configured to receive recording signals containing commands and image data, which are transmitted from a host apparatus 1000 provided in the form of a computer, a digital camera, or a scanner as appropriate. Further, the interface 1700 is configured to transmit status information of the recording apparatus 500 to the host apparatus 1000 as necessary. A control portion 90 includes an MPU 1701, a ROM 1702, a DRAM 1703, a gate array (G. A.) 1704, an energy table 1725, and a non-volatile memory 1726 such as an EEPROM. The MPU 1701 is configured to control the respective portions inside the recording apparatus 500 based on necessary data and control programs, which are stored in the ROM 1.702 and correspond to procedures of cleaning processing and energy setting processing described later with reference to FIG. 8. The following are examples of the data stored in the ROM 1702.

Steady-state drive conditions for the liquid ejection head 1, such as a shape and an application period of a drive pulse to be applied to the first electrothermal conversion portion 151

Voltage to be applied between the upper electrode 131 and the opposing electrode 132

Value of a voltage and shape and application period of a drive pulse to be applied to the second electrothermal conversion portion 152 in the heating unit 140

Further, conditions for recording medium conveyance or carriage speed may be included in the data.

The DRAM 1703 stores various kinds of data (such as the above-mentioned recording signals and recording data to be supplied to the liquid ejection head 1). Further, the DRAM 1703 may have a storage area for flags to be used in a control process described later. The gate array 1704 is configured to control the supply of the recording data to the liquid ejection head 1, and also to control the data transfer between the interface 1700, the MPU 1701, and the DRAM 1703. The energy table 1725 stores data for determining energy required for ink ejection, such as a pulse width of an ejection signal. The non-volatile memory 1726 stores necessary data also while the recording apparatus 500 is turned OFF. Further, the energy table 1725 may store data for determining energy to be applied to the second electrothermal conversion portion 152.

The carriage drive motor 504 is as illustrated in FIG. 5. A conveyance motor 1709 is used as a drive source configured to convey the recording sheet P. A recovery system motor 1711 is used as a drive source for a capping operation to be performed by the cap members 513 illustrated in FIG. 5, and for an operation of a suction recovery unit such as a pump configured to perform the suction recovery. Motor drivers 1706, 1707, and 1708 are configured to drive the conveyance motor 1709, the carriage drive motor 504, and the recovery system motor 1711, respectively. A head driver 1705 is configured to drive the liquid ejection head 1, and also to perform the cleaning operation and the ejection energy setting operation. The heating unit 140 is illustrated in FIG. 7, but the heating unit 140 may be built into the head driver 1705.

(4. Cleaning Sequence)

Figure 8:
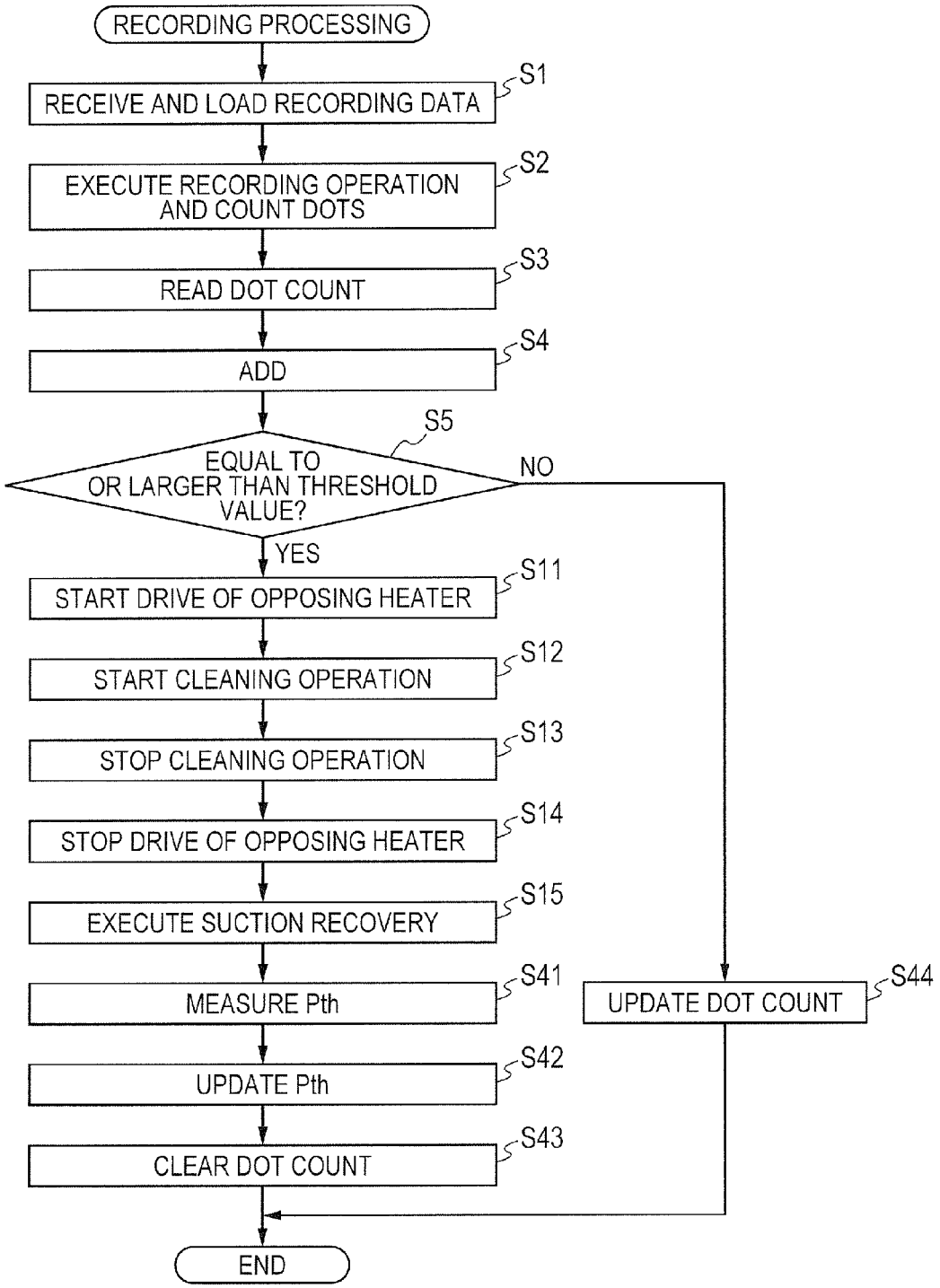
FIG. 8 is a flowchart for illustrating an example of a procedure of a cleaning operation to be performed in a first embodiment of the present invention.

FIG. 8 is a flowchart for illustrating an example of the procedure of the cleaning processing that can be performed by the recording apparatus 500 using the liquid ejection head 1 of the present invention.

This procedure is started in response to a recording instruction issued from the host apparatus 1000. First, image data relating to the recording is received from the host apparatus 1000, and is loaded as data compatible with the recording apparatus 500 (Step S1). Then, based on the loaded recording data, a recording operation is executed by the liquid ejection head 1 while the conveyance of the recording sheet P and the main scanning of the carriage 505 are being performed alternately (Step S2). At this time, the number of recording dots (number of drive pulses of the first electrothermal conversion portion 151) is counted.

When the recording operation for one unit (for example, for one recording sheet) is finished, cumulative data of the dot count values stored in the non-volatile memory 1726 is read (Step S3), and the number of dots counted currently is added to the cumulative data (Step S4). Next, it is determined whether or not the value obtained by addition is equal to or larger than a predetermined value Th (for example, $1\times10^7$) ("YES" or "NO" in Step S5).

When it is determined that the value obtained by addition is equal to or larger than the predetermined value Th ("YES" in Step S5), the cleaning operation is started.

Now, a first embodiment of the present invention is described with reference to FIG. 8. The first embodiment involves a step of heating, during the cleaning operation, a part of the opposing electrode wiring that is located inside the liquid chamber 117 on the periphery of the opposing electrode.

In the heating unit 140 illustrated in FIG. 1, drive of the second electrothermal conversion portion 152 (may be referred to as "opposing electrode wiring heater") is started (Step S11). In the cleaning unit 130 illustrated in FIG. 1, a voltage is applied so that the upper electrode 131 corresponds to the anode side and the opposing electrode 132 corresponds to the cathode side, to thereby execute the cleaning operation (Step S12). After the cleaning operation is completed (Step S13), the drive of the opposing electrode wiring heater is stopped (Step S14).

It is preferred that the opposing electrode wiring heater be driven by a pulse voltage rather than maintaining the opposing electrode wiring heater constantly at several hundreds of degrees Celsius because ink degradation does not occur. Further, a threshold value of energy at which bubbles are formed in the ink by the heater located below the opposing electrode wiring is represented by Eth, and a coefficient of overall heat transmission (k-value) at the threshold value is assumed to be 1. In the present invention, drive conditions for the opposing electrode wiring heater may be set irrespective of whether the k-value is equal to or larger than 1 (equal to or larger than the value at which bubbles are formed in the liquid) or the k-value is smaller than 1 (smaller than the value at which bubbles are formed in the liquid).

In the cleaning operation, the kogation deposited on the heat acting portion 108 is removed along with the dissolution of the surface of the upper electrode 131 through the electrochemical reaction. After the cleaning operation is performed, the liquid (ink) containing the dissolved material forming the upper electrode 131 and the peeled kogation stagnates in the vicinity of the liquid ejection orifice 121. When the ink does not affect the recording quality, the ink may be used for a subsequent recording operation as it is to be ejected through the liquid ejection orifice 121. In this embodiment, however, the suction recovery is performed (Step S15) to actively discharge the ink.

In the cleaning operation, the kogation deposited on the heat acting portion 108 is removed along with the dissolution of the surface of the upper electrode 131 through the electrochemical reaction. Along with the cleaning operation, the surface of the upper electrode 131 is dissolved, and hence the film thickness of the upper electrode 131 in the heat acting portion 108 is reduced. Therefore, in order to maintain high recording quality, Pth, which is a threshold value of a pulse width required for the formation of bubbles, is measured again, and is stored and updated (Step S41 and Step S42). After that, the cumulative data of the dot count values stored in the non-volatile memory 1726 is cleared (reset) (Step S43), and the series of steps of the recording processing is ended.

When it is determined in Step S5 that the value obtained by addition is not equal to or larger than the predetermined value Th ("NO" in Step S5), on the other hand, the cumulative data of the dot count values stored in the non-volatile memory 1726 is updated with the above-mentioned value obtained by addition (Step S44), and the recording processing is ended.

In the above-mentioned procedure, the kogation removal processing or the recovery processing is performed after the recording operation, but may be performed prior to the recording operation. In this case, the number of dots is counted based on the recording data loaded in Step S1, and is added to the cumulative dot count value. Based on the value obtained by addition, it can be determined whether or not to perform the kogation removal processing. Alternatively, the kogation removal processing may be performed every time a predetermined amount of the recording operation (for example, one or several times of scanning of the liquid ejection head 1) is performed.

Further, the processing for discharging the liquid after the kogation removal processing is not limited to the above-mentioned suction recovery. The liquid may be discharged by pressurizing the ink supply system leading to the liquid ejection orifices 121. Alternatively, the liquid may be discharged through processing of ejecting the ink by driving the first electrothermal conversion portion 151 separately from the recording operation (auxiliary ejection processing). In this case, drive pulses for the auxiliary ejection may also be reflected on the above-mentioned count.

As described above, in the cleaning method of this embodiment, the opposing electrode wiring heater is driven during the cleaning operation, thereby suppressing occlusion of hydrogen generated on the opposing electrode into the opposing electrode wiring. Therefore, no crack is generated in the opposing electrode wiring even when the cleaning is repeated, thereby being capable of performing the cleaning processing excellent in stability for a long period of time.

Next, a second embodiment of the present invention is described with reference to FIG. 9. The second embodiment involves a step of heating, after the cleaning operation, a part of the opposing electrode wiring that is located inside the liquid chamber 117 on the periphery of the opposing electrode.

The processing up to Step S5 involving the determination for the value obtained by adding the dot count is the same as that of the first embodiment. When it is determined that the value obtained by addition is equal to or larger than the predetermined value Th ("YES" in Step S5), the cleaning operation is started (Step S21). After a predetermined period of time has elapsed, the cleaning operation is stopped (Step S22), and the suction recovery is executed (Step S23). After that, the ink inside the liquid chamber 117 is discharged (Step S24). As the processing for discharging the liquid, the suction recovery may be executed or the liquid may be discharged by pressurizing the ink supply system leading to the liquid ejection orifices 121. After the ink inside the liquid chamber 117 is discharged sufficiently, the opposing electrode wiring heater is driven to start heating (Step S25). At this time, the ink inside the liquid chamber 117 is discharged, and hence the drive conditions may be set without considering the ink degradation. Therefore, the opposing electrode wiring heater may be driven by any of a DC voltage and a pulse voltage.

After that, the drive of the opposing electrode wiring heater is stopped to stop the heating (Step S26), and the ink is refilled (Step S27). Subsequent steps are the same as those of the first embodiment.

As described above, in the cleaning method of this embodiment, hydrogen occluded into the opposing electrode wiring during the cleaning operation can be forced out by driving the opposing electrode wiring heater after the ink is discharged. The ink is not contained in the liquid chamber, and hence more effective drive conditions can be set.

Subsequently, a third embodiment of the present invention is described with reference to FIG. 10. The third embodiment involves a step of heating, during the cleaning operation, a part of the opposing electrode wiring that is located inside the liquid chamber 117 on the periphery of the opposing electrode. Further, the step of heating is performed while replacing the liquid inside the liquid chamber 117.

The processing up to Step S5 involving the determination for the value obtained by adding the dot count is the same as that of the first embodiment. When it is determined that the value obtained by addition is equal to or larger than the predetermined value Th ("YES" in Step S5), the suction recovery is started (Step S31). After that, the drive of the opposing electrode wiring heater is started (Step S32), and the cleaning operation is started (Step S33). After a predetermined period of time has elapsed, the cleaning operation is stopped (Step S34), and the drive of the opposing electrode wiring heater is stopped (Step S35). Then, the suction recovery operation is stopped (Step S36). Subsequent steps are the same as those of the first embodiment.

As described above, in the cleaning method of this embodiment, the opposing electrode wiring heater is driven during the suction recovery (during the replacement operation for replacing the liquid), and hence the degraded ink is discarded. Therefore, the opposing electrode wiring heater can be driven without considering the effect on printing, thereby being capable of forcing hydrogen out of the opposing electrode wiring more effectively.

EXAMPLES

Now, the embodiments of the present invention are described in detail by way of examples, but the present invention is not limited only to those examples.

Example 1

Manufacture of Liquid Ejection Head

In order to obtain the liquid ejection head of FIG. 2 (or FIG. 3) as a liquid ejection head of Example 1 in the same manner as in the method disclosed in Japanese Patent Application Laid-Open No. 2008-105364, the heat accumulation layer 102 formed of $SiO_2$, the heat generating resistor layer 103 formed of TaSiN, the wiring layer 104 formed of Al, and the protective layer 105 formed of SiN were sequentially formed on the substrate 101 formed of Si. Note that, the first electrothermal conversion portion 151 and the second electrothermal conversion portion 152 were formed by removing a part of the wiring layer 104 formed of Al by etching. After that, a tantalum film was formed on the protective layer 105 at a thickness of 100 nm as each of the close-contact wiring layers 116 and 136, and then an iridium film was formed at a thickness of 50 nm. The iridium film was patterned to form each of the upper electrode 131 and the opposing electrode 132. After that, in the same manner as in Japanese Patent Application Laid-Open No. 2008-105364, the liquid supply path 107, the flow path forming member 120, and other necessary terminal portions were formed, to thereby complete the liquid ejection head. Note that, in Example 1, an ink tank-separated head unit was constructed instead of the ink tank-integrated head unit as illustrated in FIG. 6.

Kogation Removal Experiment

A kogation removal experiment using the above-mentioned liquid ejection head was conducted in accordance with the procedure of the cleaning operation of FIG. 8 according to the first embodiment.

Ink containing magenta dye was used as the ink. As a method of the experiment, first, a new ink tank was set on the liquid ejection head, and the first electrothermal conversion portion 151 was driven under predetermined conditions to form kogation so as to be deposited on the heat acting portion 108. When the surface state was observed, impurities called "kogation K" were deposited substantially uniformly on the heat acting portion 108. When recording was performed through use of the liquid ejection head in this state, it was recognized that the recording quality was degraded due to the deposition of the kogation K. When the k-value at the threshold value of energy at which bubbles were formed in the ink was assumed to be 1.0, the drive conditions for the opposing electrode wiring heater (second electrothermal conversion portion 152) were set such that the k-value became 0.8. In this setting, a pulse voltage was applied, and cleaning was performed. After the cleaning was finished, the application of the pulse voltage was stopped, and the suction recovery was performed. After that, the print quality was verified.

The serial processing flow: "setting of new ink tank, drive for forming kogation, drive of opposing electrode wiring heater, cleaning operation, and verification of print quality" was assumed to be one sequence, and this sequence was performed in five cycles. Note that, the kogation removal conditions were set to 10 V and 40 seconds.

When the surface state of the heat acting portion 108 was observed after the sequence was finished in each cycle, it was recognized that the deposited kogation K was removed, and even no crack was generated in the opposing electrode wiring. When the recording was performed after the ink tank was replaced, the recording quality was recovered as being substantially equivalent to the initial recording quality.

Example 2

The same experiment as that of Example 1 was conducted with the exception that the drive conditions for the opposing electrode wiring heater of Example 1 were set such that the k-value became 1.2. When the surface state was observed after the sequence of five cycles was finished, it was recognized that the kogation K was removed, and even no crack was generated in the opposing electrode wiring.

Comparative Example 1

The kogation removal experiment was conducted under the same conditions as those of Example 1 with the exception that the opposing electrode wiring heater was not driven. After the sequence of five cycles was finished, the kogation K remaining after the removal and the crack generated in the opposing electrode wiring were observed.

Example 3

Figure 9:
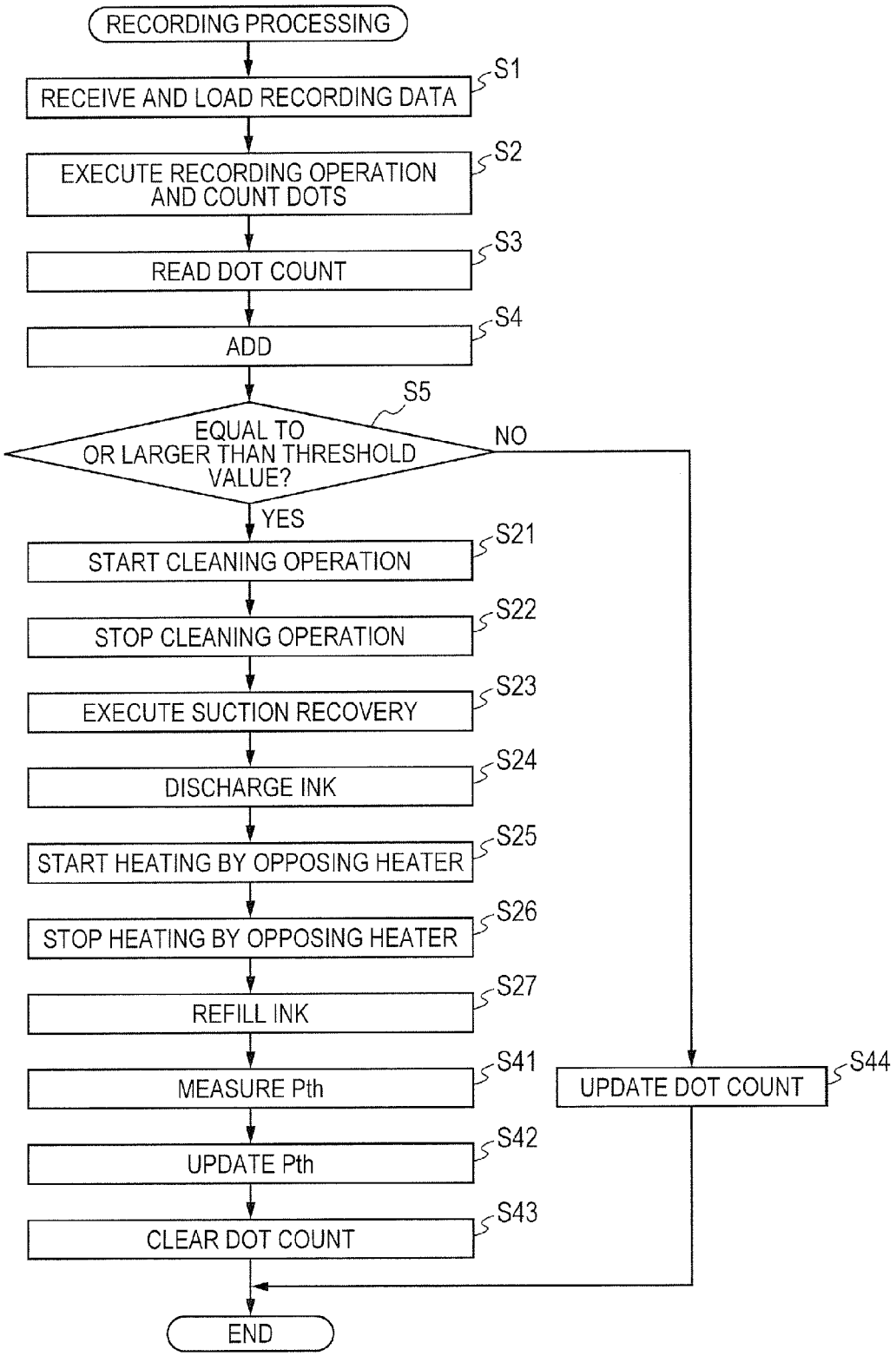
FIG. 9 is a flowchart for illustrating an example of a procedure of a cleaning operation to be performed in a second embodiment of the present invention.

A kogation removal experiment using the liquid ejection head manufactured in Example 1 was conducted in accordance with the procedure of the cleaning operation of FIG. 9 according to the second embodiment of the present invention.

Ink containing magenta dye was used as the ink. As a method of the experiment, first, a new ink tank was set on the liquid ejection head, and the first electrothermal conversion portion 151 was driven under predetermined conditions to form kogation so as to be deposited on the heat acting portion 108. When the surface state was observed, impurities called "kogation K" were deposited substantially uniformly on the heat acting portion 108. When recording was performed through use of the liquid ejection head in this state, it was recognized that the recording quality was degraded due to the deposition of the kogation K. After that, cleaning was performed under conditions of 10 V and 40 seconds. Through suction from the liquid ejection orifices 121, the ink inside the liquid chamber 117 was discharged (Step S24). After that, a DC voltage was applied to the opposing electrode wiring heater so that the temperature became 200° ° C.

The serial processing flow: "setting of new ink tank, drive for forming kogation, cleaning operation, drive of opposing electrode wiring heater, and verification of print quality" was assumed to be one sequence, and this sequence was performed in five cycles.

When the surface state of the heat acting portion 108 was observed after the sequence was finished in each cycle, it was recognized that the deposited kogation K was removed, and even no crack was generated in the opposing electrode wiring. When the recording was performed after the ink tank was replaced, the recording quality was recovered as being substantially equivalent to the initial recording quality.

Example 4

Figure 10:
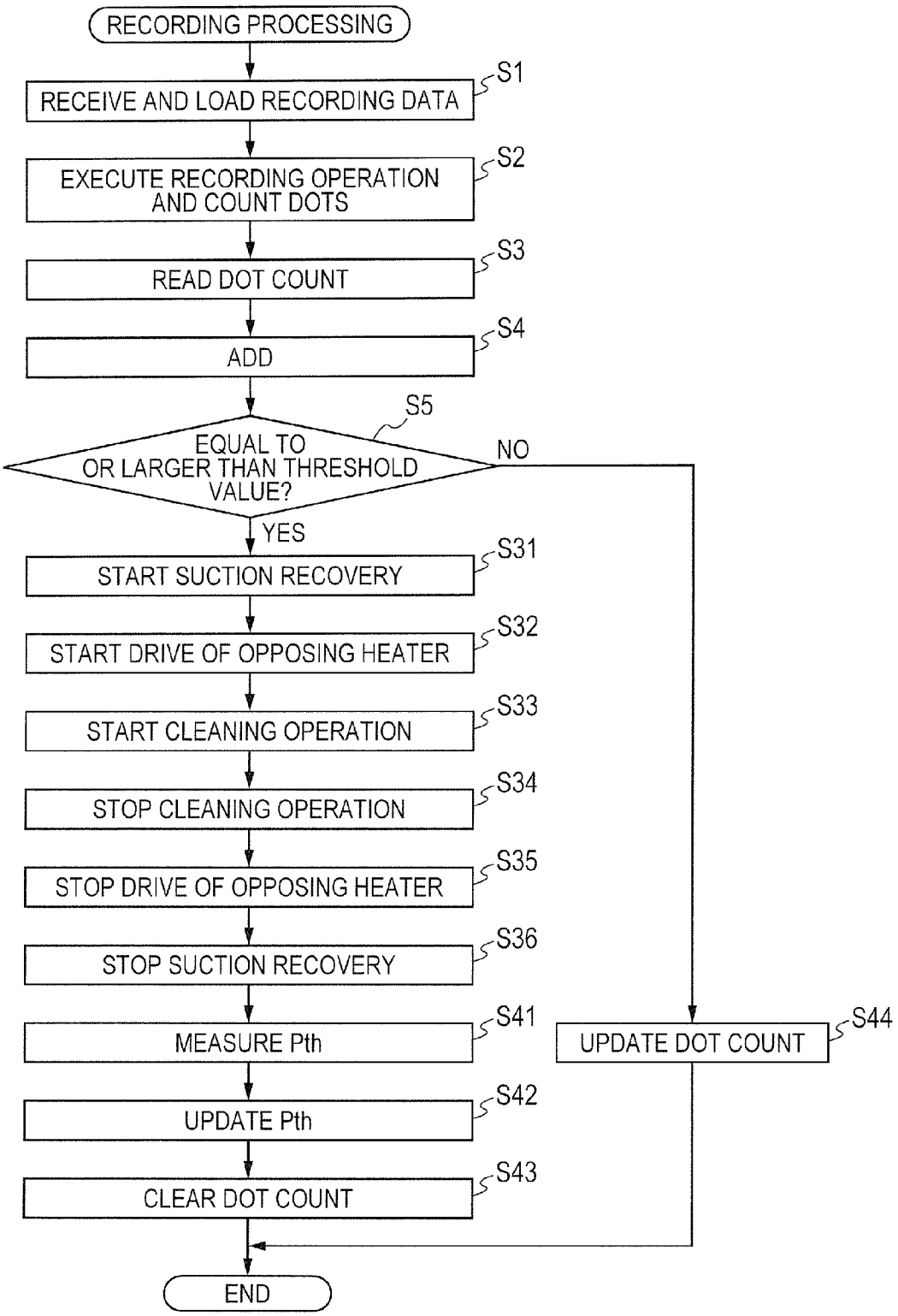
FIG. 10 is a flowchart for illustrating an example of a procedure of a cleaning operation to be performed in a third embodiment of the present invention.

A kogation removal experiment using the liquid ejection head manufactured in Example 1 was conducted in accordance with the procedure of the cleaning operation of FIG. 10 according to the third embodiment of the present invention.

Ink containing magenta dye was used as the ink. As a method of the experiment, first, a new ink tank was set on the liquid ejection head, and the first electrothermal conversion portion 151 was driven under predetermined conditions to form kogation so as to be deposited on the heat acting portion 108. When the surface state was observed, impurities called "kogation K" were deposited substantially uniformly on the heat acting portion 108. When recording was performed through use of the liquid ejection head in this state, it was recognized that the recording quality was degraded due to the deposition of the kogation K. After that, an ink tank was set, suction recovery was performed, the opposing electrode wiring heater was driven, and a cleaning operation was performed.

The drive conditions for the opposing electrode wiring heater were set to such a pulse voltage that the k-value became 1.3. After the cleaning was finished, the application of the pulse voltage was stopped, and the suction recovery was stopped. After that, the print quality was verified.

The serial processing flow: "setting of new ink tank, drive for forming kogation, suction operation, drive of opposing electrode wiring heater, cleaning operation, and verification of print quality" was assumed to be one sequence, and this sequence was performed in five cycles. Note that, the kogation removal conditions were set to 10 V and 40 seconds.

When the surface state of the heat acting portion 108 was observed after the sequence was finished in each cycle, it was recognized that the deposited kogation K was removed, and even no crack was generated in the opposing electrode wiring. When the recording was performed after the ink tank was replaced, the recording quality was recovered as being substantially equivalent to the initial recording quality.

In the above-mentioned examples, the kogation removal was performed under the conditions that the period of time was extended, namely the conditions of 10 V and 40 seconds, as compared to normal conditions of 10 V and 10 seconds to 30 seconds. The hydrogen embrittlement occurs even under the cleaning conditions that the voltage is increased to increase the hydrogen generation rate, and that a normal voltage is applied and the number of times of cleaning is increased. According to the present invention, the crack of the opposing electrode wiring can be prevented even under those conditions. As a result of taking the above-mentioned measures, the stop period of the recording apparatus can be shortened. In the present invention, the crack of the opposing electrode wiring due to the hydrogen embrittlement is prevented, thereby being capable of securely performing the cleaning operation up to a predetermined number of times. Further, the ejection characteristics of the liquid ejection head are stabilized through sufficient kogation removal, thereby being capable of performing reliable and high-quality image recording. Thus, industrial applicability of the present invention is extremely high.

The above description is directed to the case where the liquid (ink) for ejection is used as the liquid, but the present invention is not limited thereto. The present invention is also applicable to a case where cleaning liquid is used at the time of recycling the liquid ejection head and hydrogen may be generated in the vicinity of the opposing electrode at the time of cleaning (kogation removal).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-095647, filed May 8, 2015, which is hereby incorporated by reference herein in its entirety.

What is claimed is:

1. A method of cleaning a liquid ejection head, the liquid ejection head comprising:

a liquid ejection orifice;

a liquid chamber communicating with the liquid ejection orifice;

a first electrothermal conversion portion disposed in the liquid chamber;

a protective layer having an insulating property and being configured to prevent contact between the first electrothermal conversion portion and liquid inside the liquid chamber;

an upper electrode covering at least a heat generation portion of the protective layer, which is heated by the first electrothermal conversion portion, and being formed of a material containing a metal to be dissolved through an electrochemical reaction with the liquid;

an opposing electrode provided such that a voltage is applied between the upper electrode and the opposing electrode for dissolution of the upper electrode; and an opposing electrode wiring connected to the opposing electrode, the method comprising:

cleaning the liquid ejection head by removing kogation, which is deposited on a surface of the upper electrode, through the dissolution of the upper electrode; and heating, during the cleaning or after the cleaning, the opposing electrode wiring, which is located at a periphery of the opposing electrode so as to be in contact with the liquid.

2. The method of cleaning a liquid ejection head according to claim 1, wherein the heating of the opposing electrode wiring comprises driving a second electrothermal conversion portion, which is disposed in the liquid ejection head at a position below the opposing electrode through intermediation of the protective layer, by a circuit connected to the second electrothermal conversion portion.

3. The method of cleaning a liquid ejection head according to claim 2, wherein the circuit connected to the second electrothermal conversion portion is configured to apply a pulse voltage to the second electrothermal conversion portion, to thereby heat the opposing electrode wiring.

4. The method of cleaning a liquid ejection head according to claim 2, wherein the circuit connected to the second electrothermal conversion portion is configured to apply, to the second electrothermal conversion portion, electric power of a value less than a value at which a bubble is formed in the liquid, to thereby heat the opposing electrode wiring.

5. The method of cleaning a liquid ejection head according to claim 2, wherein the circuit connected to the second electrothermal conversion portion is configured to apply, to the second electrothermal conversion portion, electric power of a value equal to or greater than a value at which a bubble is formed in the liquid, to thereby heat the opposing electrode wiring.

6. The method of cleaning a liquid ejection head according to claim 1, wherein the opposing electrode wiring is disposed so as to be in contact with the liquid inside the liquid chamber, and wherein the heating of the opposing electrode wiring is performed in a state in which the liquid inside the liquid chamber is discharged.

7. The method of cleaning a liquid ejection head according to claim 1, wherein the opposing electrode wiring is disposed so as to be in contact with the liquid inside the liquid chamber, and wherein the heating of the opposing electrode wiring is performed while replacing the liquid inside the liquid chamber.

8. The method of cleaning a liquid ejection head according to claim 1, wherein the opposing electrode wiring is formed of a material containing Ta or Nb.

9. A recording apparatus configured to perform recording through use of a liquid ejection head, the liquid ejection head comprising:

a liquid ejection orifice;

a liquid chamber communicating with the liquid ejection orifice;

a first electrothermal conversion portion disposed in the liquid chamber;

a protective layer having an insulating property and being configured to prevent contact between the first electrothermal conversion portion and liquid inside the liquid chamber;

an upper electrode covering at least a heat generation portion of the protective layer, which is heated by the first electrothermal conversion portion, and being formed of a material containing a metal to be dissolved through an electrochemical reaction with the liquid;

an opposing electrode; and an opposing electrode wiring connected to the opposing electrode, the opposing electrode wiring being located at a periphery of the opposing electrode so as to be in contact with the liquid, the recording apparatus comprising:

a cleaning unit configured to remove kogation, which is deposited on a surface of the upper electrode, through dissolution of the upper electrode, which is caused by applying a voltage between the upper electrode and the opposing electrode; and a unit configured to heat the opposing electrode wiring.

10. The recording apparatus according to claim 9, wherein the unit configured to heat the opposing electrode wiring comprises:

a second electrothermal conversion portion disposed in the liquid ejection head at a position below the opposing electrode through intermediation of the protective layer; and a circuit configured to drive the second electrothermal conversion portion.

11. The recording apparatus according to claim 10, wherein a part of the circuit configured to drive the second electrothermal conversion portion is disposed inside the liquid ejection head, and wherein another part of the circuit, which is different from the part disposed inside the liquid ejection head, is disposed outside the liquid ejection head.

12. The recording apparatus according to claim 9, further comprising a unit configured to suck the liquid inside the liquid chamber from the liquid ejection orifice.

* * * * *